US006065399A

United States Patent [19]

Eppinger

[11] Patent Number: 6,065,399

[45] Date of Patent: May 23, 2000

[54] SCREEN PRINTING MACHINES

[75] Inventor: Otto Richard Eppinger, Braeside, Australia

[73] Assignee: Reefdale Proprietary Limited, Victoria, Australia

[21] Appl. No.: 09/175,539

[22] Filed: Oct. 20, 1998

[51] Int. Cl.[7] ..... B41F 15/34

[52] U.S. Cl. ..... 101/127.1; 101/128.1

[58] Field of Search ..... 101/127.1, 126, 101/128, 128.1, 115, 129, DIG. 36

[56] References Cited

U.S. PATENT DOCUMENTS 5,022,320 6/1991 Szarka ..... 101/127.1
5,765,476 6/1998 McKeever ..... 101/127.1
5,787,805 8/1998 Szyszko ..... 101/126

*Primary Examiner*—John Hilten
*Assistant Examiner*—Amanda B. Sandusky
*Attorney, Agent, or Firm*—Pollock, Vande Sande & Amernick

[57] ABSTRACT

A screen off contact arrangement in which a rectangular screen holding frame [11] is adapted to secure the screen [13] on its two side rails [17,18]. Four off contact devices at the corners of the frame [11] allow adjustment of the off contact distance between the screen and the pallet. A scaled knob [33] enables incremental movement of the shaft [29] to move it relative to the fixed front and rear rails [15,16]. Each shaft [29] is secured to the ends of the side rails [17,18] so that incremental movement of the knob [33] results in movement of the screen [13]. The advantage is a simple repeatable manual adjustment.

1 Claim, 3 Drawing Sheets

FIG. 1 (ITEM 11)

SCREEN PRINTING MACHINES

This invention relates to improvements in screen printing machines particularly to the screen off contact device used in such machines.

BACKGROUND TO THE INVENTION

Garments such as tee shirts are decorated using multi printing head, screen printing machines. The number of heads correspond to the number of colours to be printed. U.S. Pat. No. 3,795,189 [Jaffa] and U.S. Pat. No. 5,031,527 [Eppinger] disclose examples of the type of machines used in printing garments.

The garments are supported on a pallet, which in turn is supported, for registry with the printing head, on a pallet arm. The pallet is moved successively past the desired number of printing heads until the printing is complete. Different size garments require correspondingly different sized pallets. Usually pallets are of the same length but vary in width from a garment sleeve width to a large body width. The positioning of the pallet on its pallet arm needs to be precise and secure to ensure that registration with successive printing heads is maintained. Also important to the quality of printing is the off contact adjustment. The off contact distance is the gap between the screen surface and the garment. To ensure that the screen will peel off the garment this distance has to be adjusted to account for garment thickness, material and ink viscosity and type. The off contact distance is adjustable for all pallets relative to all printing heads and some machines have a central off contact control that adjusts all print heads to be the same distance from the pallet arms. However individual adjustment for each individual print head relative to each pallet is also needed.

Conventionally the individual adjustment of the screen off contact is made by adjusting the screen holding frame relative to the print head arm. The screen holder frame was connected to the print frame by screw threaded shafts passing through holes in the holder frame and having a pair of threaded nuts on said shaft on either side of said frame. The spacing of the holder frame from the print arm was adjusted by turning the pair of nuts in opposite directions to move the holder frame along the shaft toward or away from the print arm. There are four such shafts at each corner of the screen holder frame. The adjustment of the two nuts required manual dexterity and the skill of the machine operator was important in achieving accurate off contact adjustment at all locations on the screen.

U.S. Pat. No. 5,787,805 discloses the use of electrically driven stepper motors at each corner of the screen holder frame to make measurable off contact adjustments for each print head. Although this arrangement makes electronic control of off contact adjustment possible it is an expensive solution to the problem and the operator does not have direct manual control over the adjustment at the screen holder but must check the screen and then return to the control panel, detracting from operator convenience.

U.S. Pat. No. 5,765,476 discloses a set up frame having 4 threaded shafts extending through the side members of the frame to project below it and contact the pallet. This set up frame is used to obtain a uniform off contact distance for all printing heads relative to all pallets. This arrangement does not cater for individual print head adjustment.

It is an object of this invention to provide a simple inexpensive and user friendly screen off contact arrangement.

BRIEF DESCRIPTION OF THE INVENTION

To this end the present invention provides a screen off contact device for a printhead of a screen printing machine including at least two members attachable to the screen and each member having at least one off contact device which includes a) a shaft fixed to said member and extending vertically from said member;

b) said shaft being supported at a point above said member by support means incorporating means to move said shaft vertically;

c) said means to move said shaft incorporating a scale to measure off incremental vertical movement of said shaft.

The shaft may be part of a rack and pinion mechanism or may be a screw threaded shaft. The scale is preferably on the perimeter of the knob which turns the pinion or the screw threaded shaft.

In a more detailed embodiment this invention provides in a screen printing machine having a plurality of printing stations each containing a screen and a plurality of pallets moveable past each printing station to achieve a multicolor print, the improvement comprising an off contact adjustment arrangement on each printing head which includes a) a substantially rectangular screen holding frame formed by two pairs of substantially parallel members, the ends of one pair of members in conjunction with the ends of the other pair forming the four corners of said frame b) said screen being attachable to one pair of said frame members c) holding means adapted to secure each end portion of each frame member d) four shafts each connected to adjacent holding means on conjoined frame members at each corner of said frame e) each of said shafts being fixed to the frame members of said one pair of frame members to which the screen is attachable and moveable relative to the other pair of frame members f) the other of said pair of frame members being fixed in position relative to the print arm of said screen printing machine g) and scale means associated with the means for moving said frame members relative to said shaft to measure off increments of movement which correspond to adjustments to the off contact distance between the screen surface and the pallet.

Preferably the front and rear frame members are fixed relative to the print head arm while the side frame members which are approximately parallel to the print arm are adapted for attachment to the screen and are moveable relative to the fixed members.

DETAILED DESCRIPTION OF THE INVENTION

A preferred embodiment of this invention will now be described with reference to the drawings in which FIG. 1, perspective schematic view of a print head and screen holding arrangement;

The off contact device of this invention is applicable to any multi color screen print machine of the oval or circular type such as those described in U.S. Pat. Nos. 5,595,113, 5,787,805, or in WO95/01875 all of which are incorporated herein by reference.

Figure 1:
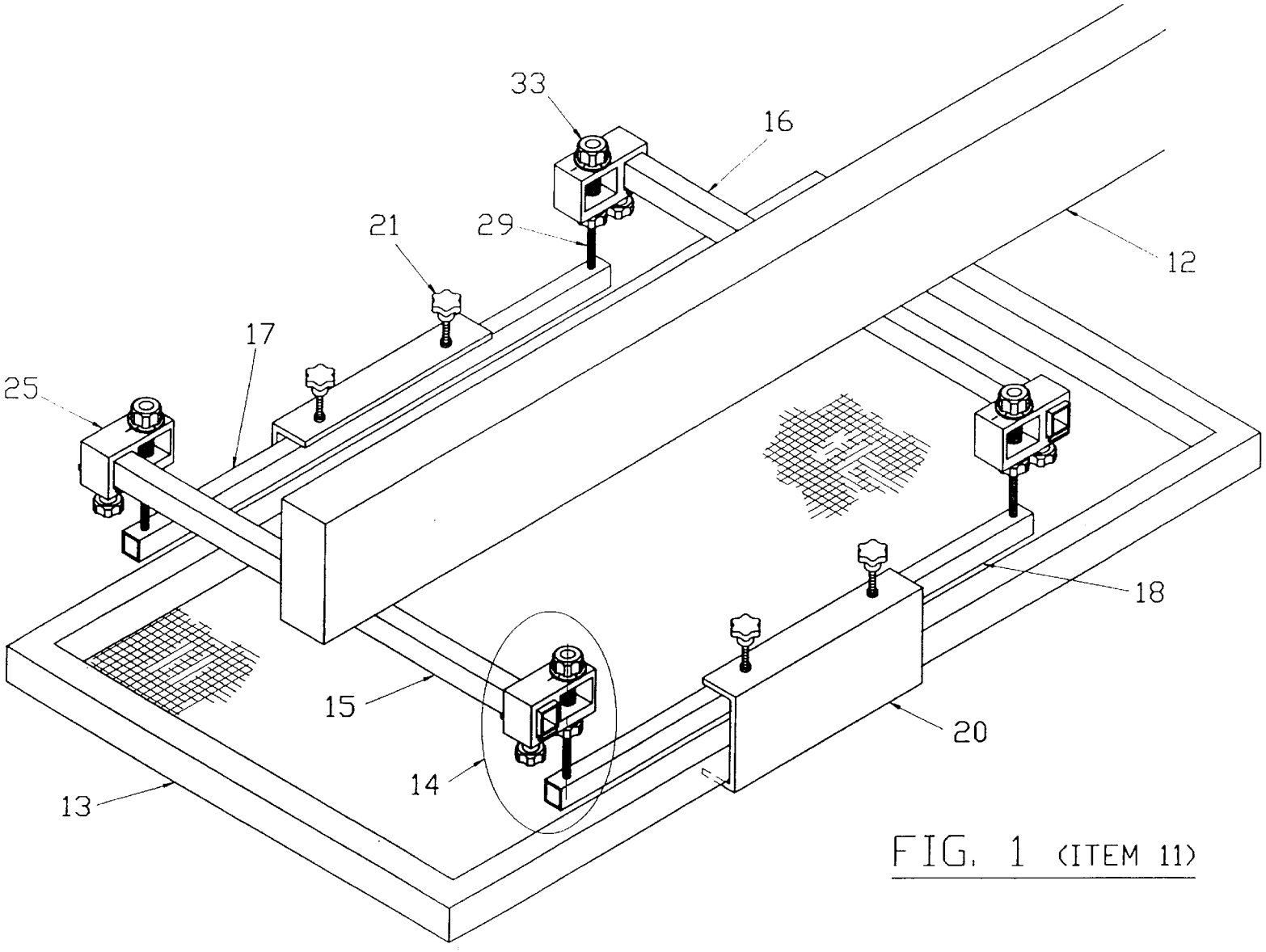

As shown in FIG. 1 each print head 11 comprises a radial print arm 12 which supports the screen holder frame 14 which in turn supports the screen 13, The screen 13 is secured to the side rails of the screen holder frame 14.

Figure 2:
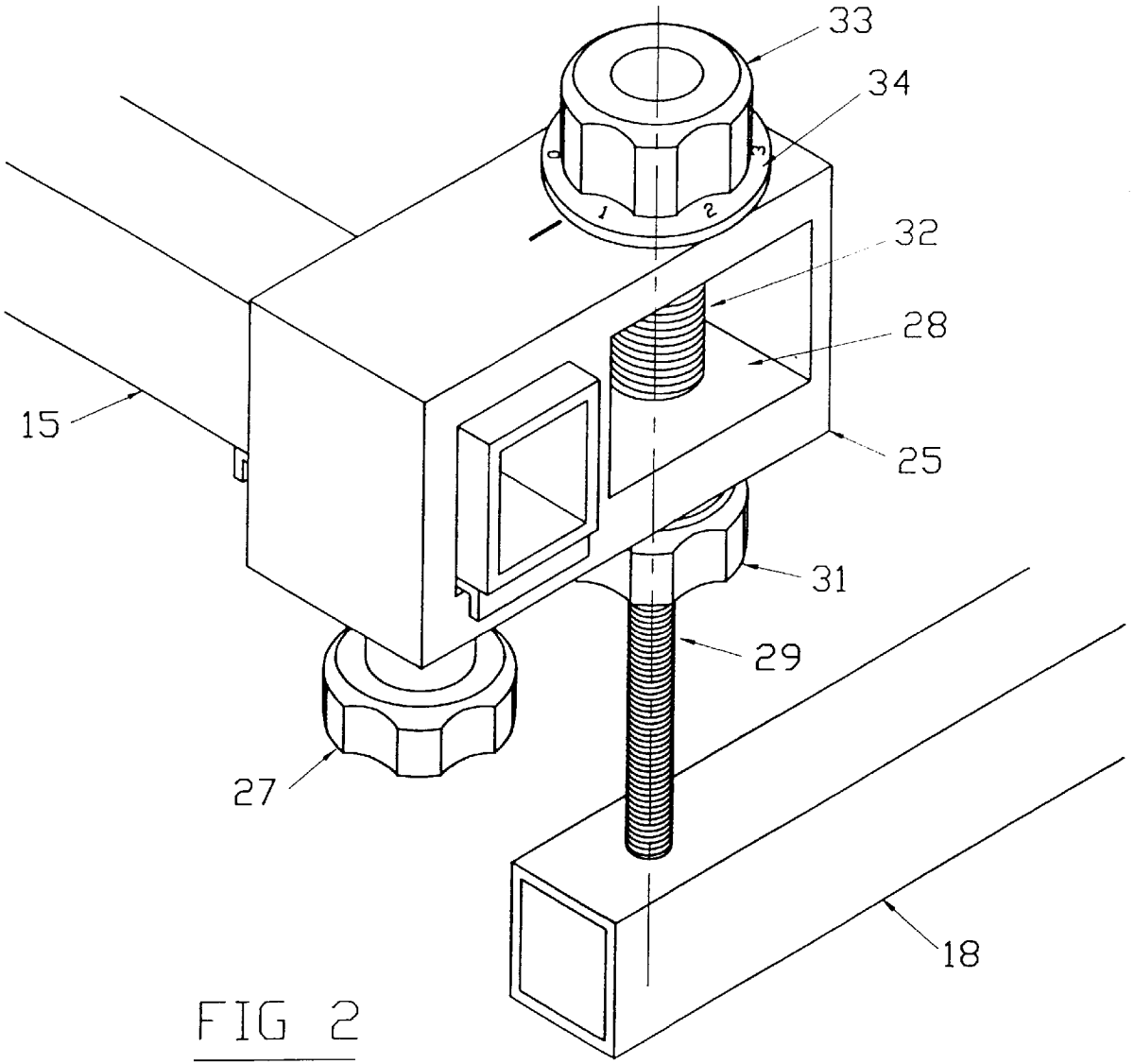
FIG. 2 is a perspective view of one of the four screen off contact devices.
Figure 4:
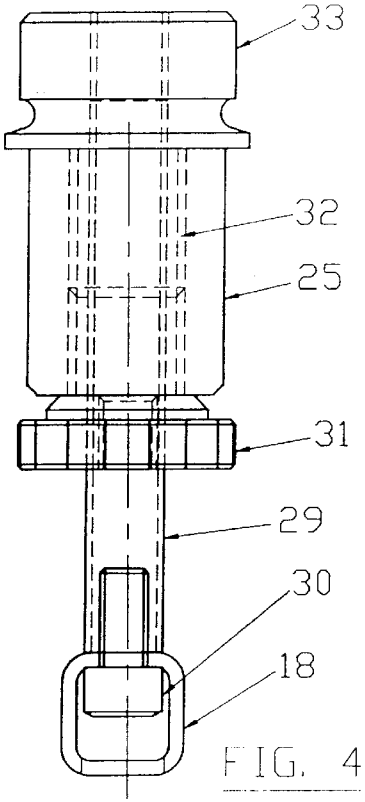
FIG. 4 is an end view of the device of FIG. 2.
Figure 5:
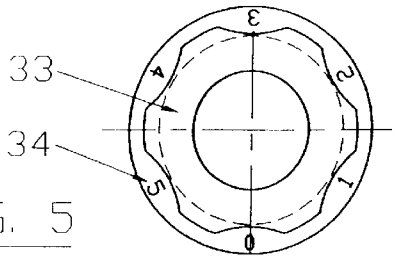
FIG. 5 is a detail plan view of the scaled dial of the device of FIG. 2.
Figure 3:
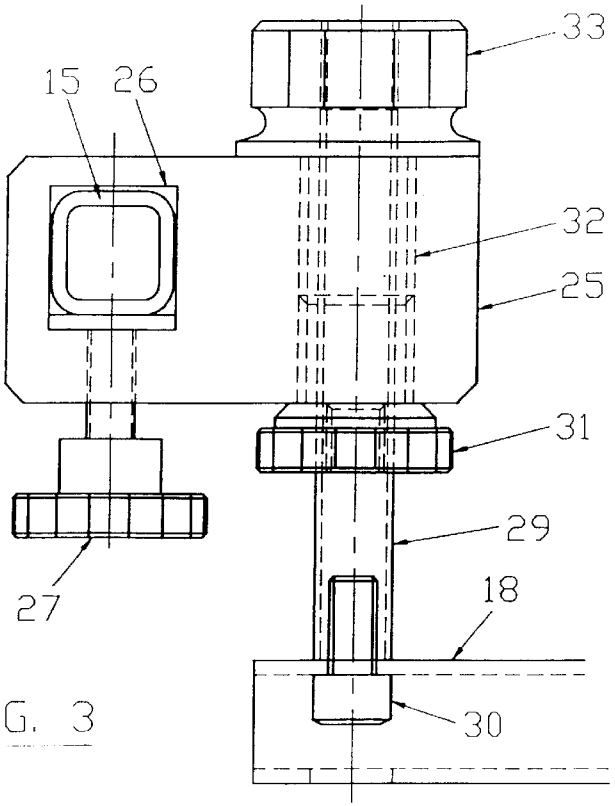
FIG. 3 is a side view of the device of FIG. 2.

Frame 14 comprises front rail 15, rear rail 16 each of which is fixed to the print arm 12 so that the frame 14 is symmetrical about print arm 12. Side rails 17 and 18 are secured to the front rail 15 and rear rail 16 by 4 off contact devices as shown in FIG. 2. The screen 13 is secured to side rails 17 and 18 by a clamp 20 with associated star knobs 21.

Turning now to FIGS. 2 to 5 the off contact device [one only of which is illustrated] the front rail 15 is secured in channel 26 of holding member 25 by a nut 27. The side rail 18 is held by the screw threaded bolt 30 secured into the end of the right hand threaded shaft 29. Bolt 30 through the rail 18 constitutes the holding means for rail 18.

Shaft 29 extends upwardly into the left hand threaded hollow cylinder 32 which passes into the recess 28 of holding member 25. The locking nut 31 secures the shaft 29 in place against the under side of holding member 25.

The left hand thread cylinder 32 is fitted with a knob 33 carrying a scale 34. Rotation of the knob 33 results in shaft 29 moving relative to the cylinder 32 and consequently rail 18 is moved relative to the fixed front rail 15. Because the position of the pallet [not shown] and the print head are relatively fixed, rotation of knob 33 will alter the distance between screen 13 and the pallet [the off contact]. The scale 34 is measured off in readable increments such as fractions of a millimeter. This enables the operator to be able to accurately repeat the off contact settings when needing to repeat a particular job.

Each of the four off contact devices are the same as that described. To those skilled in the art other arrangements for incrementally moving the shaft 29 will be apparent. The shaft 29 could be a rack and if the knob 33 were moved through 90° it could be modified to be a pinion.

From the above it can be seen that the present invention provides an inexpensive and user friendly manual off contact device.

I claim:

1. In a screen printing machine having a plurality of printing stations each containing a screen and a plurality of pallets moveable past each printing station to achieve a multicolor print, the improvement comprising an off contact adjustment arrangement on each printing station which includes:

a) a substantially rectangular screen holding frame formed by two pairs of substantially parallel members, the ends of one pair of members in conjunction with the ends of the other pair forming the four corners of said frame;

b) said screen being attachable to one pair of said frame members;

c) holding means adapted to secure each end portion of each frame member;

d) four shafts each connected to adjacent holding means on conjuncted frame members at each corner of said frame members;

e) each of said shafts being fixed to the frame members of said one pair of frame members to which the screen is attachable and moveable by movement means relative to the other pair of frame members;

f) the other of said pair of frame members being fixed in position relative to said screen printing machine;

g) and scale means associated with said movement means for moving said frame members relative to said shaft to measure off increments of movement which correspond to adjustments to the off contact distance between the screen surface and the pallet.

* * * * *